US005279786A

United States Patent [19]

Cho

[11] Patent Number: 5,279,786

[45] Date of Patent: Jan. 18, 1994

[54] ALUMINUM POWDER PREPARED FROM SCRAP ALUMINUM AND MULTI-LAYER, POROUS SOUND ABSORBING MATERIAL PREPARED THEREFROM WITH A SHELL CONFIGURATION OF A CONCH FOR EFFECTIVELY ABSORBING NOISE

[75] Inventor: Seong S. Cho, Daejeon, Rep. of Korea

[73] Assignee: Jae Chang Byun, Daejeon, Rep. of Korea

[21] Appl. No.: 959,427

[22] Filed: Oct. 13, 1992

[30] Foreign Application Priority Data

Oct. 10, 1991 [KR] Rep. of Korea ..... 91-17963

[51] Int. Cl.[5] ..... B22F 3/00; E04B 1/74

[52] U.S. Cl. ..... 419/23; 419/32; 75/249; 252/62

[58] Field of Search ..... 501/80, 82; 252/62; 106/122; 419/2, 23, 32, 57; 75/249

[56] References Cited

U.S. PATENT DOCUMENTS

| | | | |
|---|---|---|---|
| 4,147,766 | 4/1979 | Kozischek | 424/14 |
| 4,283,465 | 8/1981 | Morimoto et al. | 428/566 |
| 4,834,281 | 5/1989 | Morimoto et al. | 228/117 |

*Primary Examiner*—Donald P. Walsh
*Assistant Examiner*—Anthony R. Chi
*Attorney, Agent, or Firm*—Birch, Steewart, Kolasch & Birch

[57] ABSTRACT

Multi-layer, porous material and process of manufacturing same produced from aluminum scrap powder by means of a centrifugal atomizer for use in noise absorbing devices and filter elements. The multi-layers are arranged according to increasing particle size so that a first layer contains the largest particle size and a last layer contains the smallest particle size. Arranging the layer sin this manner produces a multilayer porous material having a shell configuration of a conch which effectively absorbs noise.

5 Claims, 3 Drawing Sheets

FIG. 1A
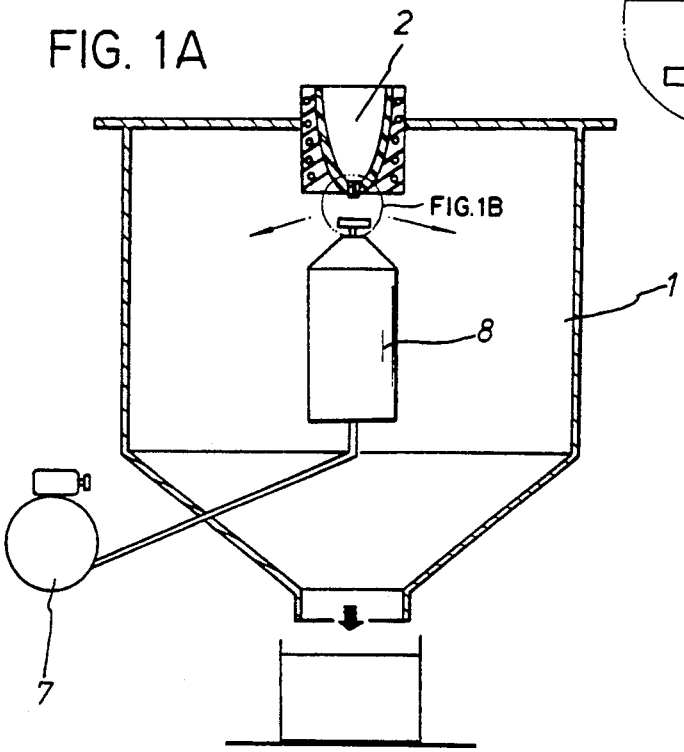
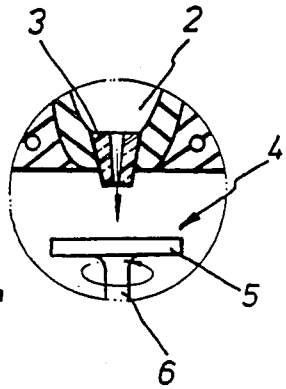
FIG. 1B
FIG. 3
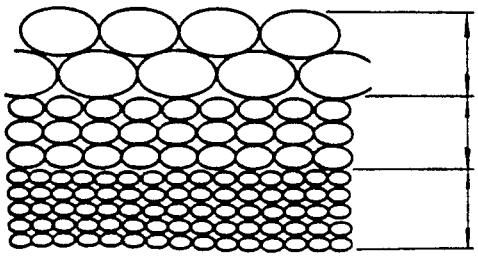
FIG. 4
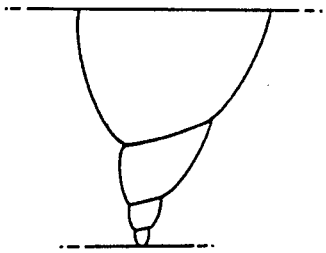

ALUMINUM POWDER PREPARED FROM SCRAP ALUMINUM AND MULTI-LAYER, POROUS SOUND ABSORBING MATERIAL PREPARED THEREFROM WITH A SHELL CONFIGURATION OF A CONCH FOR EFFECTIVELY ABSORBING NOISE

BACKGROUND OF THE INVENTION

1. Field of the Invention

The present invention relates to the production of aluminum powder from scraps of aluminum and to multi-layer, porous materials produced therefrom for use in noise absorbing devices and filter elements for automobiles and air conditioners. More particularly, the present invention relates to a method in the preparation of multi-layer, porous materials comprising producing aluminum powder by a centrifugal atomization method from scrap aluminum and sintering the resulting aluminum powder with bonding materials.

2. Description of the Related Art

In accordance with industrial development, the demand for aluminum materials is increasing every year and the amount of scrap aluminum is also increasing. This not only contributes to public nuisances, but also many problems in terms of recycling. Currently existing methods of producing metal powder in large quantity use water atomization and gas atomization. Since materials like aluminum are easily oxidized and cannot be powdered by water atomization, aluminum powder is produced by gas atomization. The method of gas atomization, however, requires large facilities, which in turn require high maintenance costs. Therefore, the gas atomization method is not suitable for producing aluminum powder from scrap aluminum. Further, the use of noise absorbing materials that are now commercially produced can be largely classified into three categories, fiber shaped materials, sintered materials, and concrete materials. The sound absorbing material should have an efficient acoustic absorbing power, fire resistance, light weight, durability, hardness, and ductility. The fiber shaped sound absorbing materials like glass fibers, however, have the disadvantages of not only a poor forming capability due to weakness in hardness and durability of the materials, but also their sound absorbing effects are reduced when they are wet. The sintered sound absorbing materials, like ceramics, are heavy in weight and exhibit no ductility, and it is difficult to construct facilities/devices therefrom. Concrete sound absorbing materials have a poor efficiency in absorbing sound of high frequency. Sintered aluminum sound absorbing materials that have been recently developed are not only very expensive, but also very weak in absorbing sound in medium and low frequencies. In addition to the aforementioned inefficiencies, the sound absorbing materials of glass fiber and ceramics cannot be used for places of high vibration.

SUMMARY OF THE INVENTION

Accordingly, it is an object of the present invention to provide a method of manufacturing powdered aluminum from scrap aluminum to fabricate multi-layer, porous materials which eliminates the above problems encountered with conventional materials.

Another object of the present invention is to provide multi-layer, porous materials for use as anti-pollution devices and the production of aluminum powder from scrap aluminum at an economical cost.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The foregoing objects and others are accomplished in accordance with the present invention generally speaking by providing a process for the preparation of multi-layer, porous sound absorbing and filtering materials which comprises producing a powder from scrap aluminum by means of a centrifugal atomizer at an economical cost inside a powder collecting chamber utilizing a ceramic rotator that is made of silicon nitride ($Si_3N_4$) or silicon nitride mixture ($Si_3N_4$+SiCw).

The aluminum powder is sintered as mixed with Al-6% Ni, Al-68% Mg, Al-35% Mg, Al-33% Cu, Al-13% Si, or Al-95% Zn at a temperature higher than the melting point of bonding materials mixed therewith in an inactive atmosphere and constituting the powder in a ceramic or graphite container by particle size, in multi-layers.

Aluminum powder is produced by means of a centrifugal atomizer and sintering the aluminum powder mixed with a bonding compound for use in noise absorbing devices and filter elements.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 1A is a sectional view of a centrifugal atomizer according to the present invention;

FIG. 1B is a blown-up section of the rotator of FIG. 1A;

FIG. 3 is a cross-sectional view of multi-layer porous materials produced from scrap aluminum powder according to the invention;

FIG. 4 is an enlarged perspective view of a pore of the porous materials according to the present invention;

DETAILED DISCUSSION

Figure 2A:
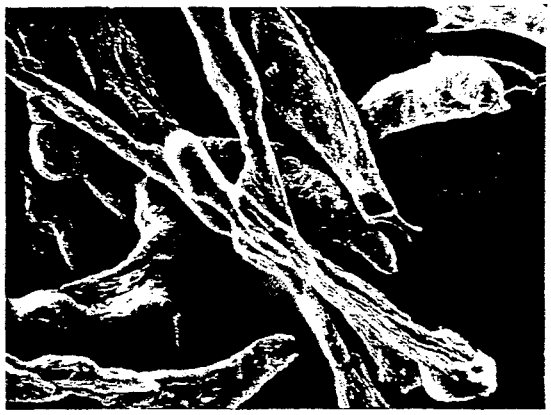
FIGS. 2A, 2B, and 2C illustrate shapes of aluminum powder produced by the centrifugal atomizer according to the invention.

Referring now in detail to the drawings for the purpose of illustrating preferred embodiments of the present invention, the multi-layer, porous materials and a process of its manufacture as shown in FIGS. 1A and 1B comprises producing aluminum powder from scrap aluminum by means of a centrifugal atomizer. The scrap aluminum is introduced into a melting furnace. The resulting melted aluminum solution is supplied to a solution tank 2, and then the solution flows into a powder collecting container, through a nozzle 3.

At this point, the flow of the solution is regulated by a centrifugal ceramic rotator 4 (FIG. 1B) at a speed of from 20,000–100,000 rpm. A fine aluminum powder of from 20 μm to 400 μm in size can be produced in the powder collecting container 1. The size of the container 1 is 3 to 4 meters in diameter and 2 meters in height. A general purpose carbon steel, aluminum or copper plate can be used for manufacturing the powder collecting container 1.

Figure 2B:
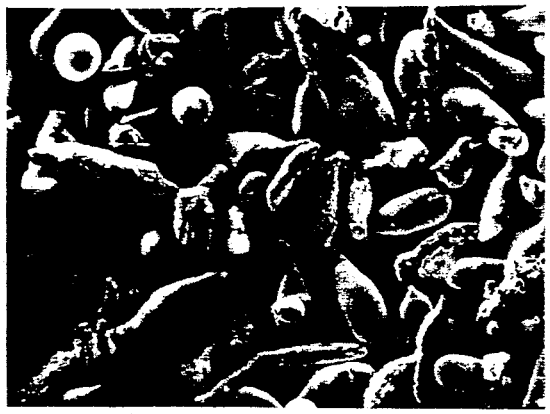
Figure 2C:
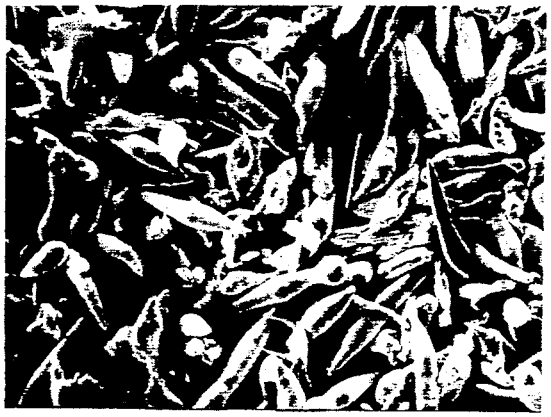

The size of the centrifugal ceramic rotator 4 of a rotator disk 5 is 30–40 mm in diameter and 3–4 mm in thickness, and the size of a shaft 6 of the ceramic rotator 4 is 20–30 mm in length and 3–6 mm in diameter. The material of these parts is silicon nitride ($Si_3N_4$) or silicon nitride mixture ($Si_3N_4$+SiCw). When these materials are manufactured to the sizes mentioned above, the most economical production of the aluminum powder is obtained. As a result, the aluminum powder atomized from the scrap aluminum by the method described above exhibits various needle-shapes and various sizes, as shown in FIGS. 2A, 2B, and 2C. This needle-shaped scrap aluminum powder has oxidized film at its surface. Since the powder sizing from 20 μm to 400 μm can be produced by regulating the speed of the centrifuged rotator 4, powder of various sizes is suitable fabricated for sound absorbing materials or filtering materials. This practical example shows the production and its method of producing sound absorbing materials and filtering materials utilizing scrap aluminum powder.

Since the scrap aluminum powder alone has no bonding power when sintering the powder, the powder should be mixed with a bonding material. The scrap aluminum powder particles produced by the above method are sorted out by size and then mixed with a bonding powder, e.g. Al-6% Ni. Then mixed powder of different sizes are scattered evenly on three layers in a ceramic or graphite container of 300 mm×600 mm×3 mm and 600 mm×600 mm×4 mm, as shown in FIG. 3. The large size powder particles comprise the first layer, the medium size powder particles comprise the second layer, and the smallest powder particles comprise the third layer.

The mixtures of powder particles are being piled up in layers in the sintering furnace, and cooling the container 1 after keeping it in the furnace for about 30 to 70 minutes at the temperature of 430° C. to 650° C. above the melting point of the bonding material (Al-6% Ni) with a pure inactive gas, such as argon gas or nitrogen gas, blowing into the furnace. If the mixed powder is sintered in an iron container, the aluminum reacts with the container. Therefore, an iron reacting container cannot be used. Other scrap aluminum powder bonding material other than al-6% Ni may be used, such as Al-68% Mg, Al-35% Mg, Al-33% Cu, Al-13% Si, and Al-95% Zn.

A cross-sectional view of the multi-layer, porous material produced from the scrap aluminum powder after the completion of the sintering is shown in FIG. 3. The third layer in the ceramic or graphite container is comprised of tiny powder mixtures (50 μm–70 μm) 1 to 1.5 mm thick, the second layer is comprised of medium size powder mixtures (100 μm–150 μm) 1 to 1.5 mm thick, and then the first layer is laid with the coarsest powder mixtures (200 μm–400 μm) 1 to 1.5 mm thick. These layers range from 3 to 5 mm in total thickness.

Since the pores of each layer are different in size and are linked to each other, the total shape of these pores assimilates a shell configuration as in a conch, as illustrated in FIG. 4.

The oxidized surface film on the aluminum powder is destroyed due to the difference of thermal expansion between aluminum and oxide at the time of sintering. If the inactive gas contains oxygen or any moisture, the aluminum rapidly oxidizes, thereby forming an oxidation layer which reduces the effect of the bonding material to react with the aluminum. The oxygen and/or moisture contained in the gas should be minimized to the maximum degree.

Figure 5:
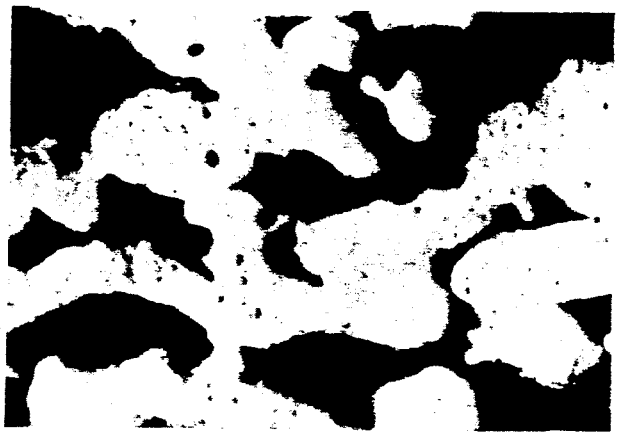
FIG. 5 illustrates a microscopic picture of a layer of FIG. 3 according to the invention.

The first and second layers absorb sound of low and medium frequencies and the second and third layers absorb sound of medium and high frequencies. This structure has good characteristics of absorbing sound, and the structure is very similar to that of the shell of a conch. FIG. 5 shows the microscopic picture to determine the density of the medium size pores of the second layer shown in FIG. 3. The second layer has a pore density of 55%. Since the pores are linked through those of 1st and 3rd layers, wave energy of sound is converted to thermal energy while it passes through these linked pores, thus absorbing sound.

The sound of low, medium, and high frequencies are absorbed as the sound passes through from the layer of coarse or larger powder particles to the layer of the finest powder particles. The sizes of the pores and densities are very important factors in the course of sound absorption.

Figure 6:
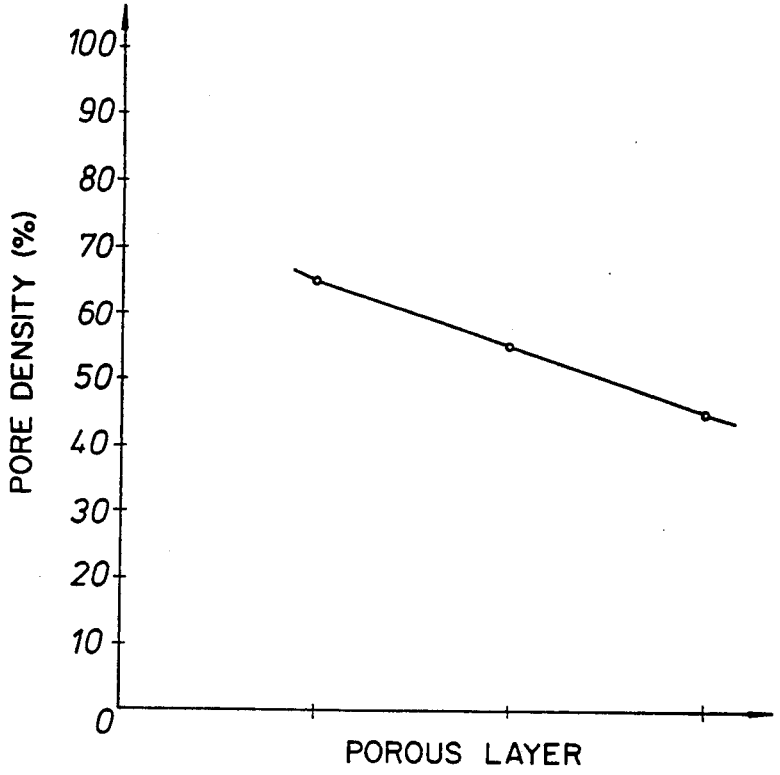
FIG. 6 illustrates porous percentages of each layer of multi-layer, porous materials according to the invention.
Figure 7:
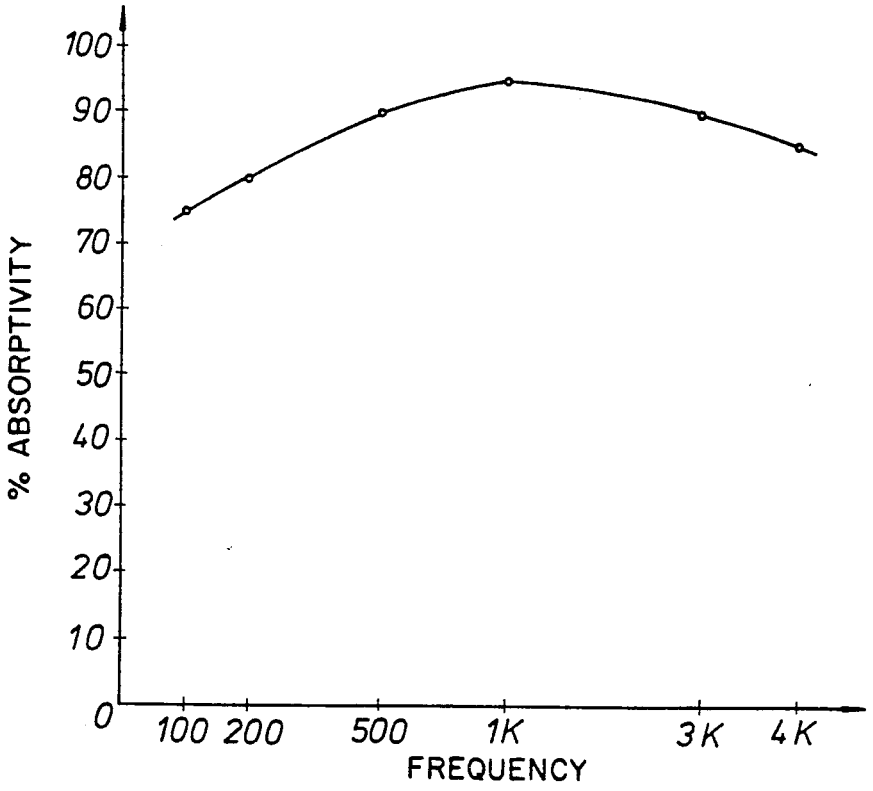
FIG. 7 illustrates the variation of acoustic absorptivity of frequency of multi-layer, porous materials according to the present invention.

The density of the pores in each layer, as shown in FIG. 6, is as follows. The first layer is 65%, second layer is 55%, and third layer is 45%. FIG. 7 shows the variation of acoustic absorptivity by sound frequencies of multi-layer, porous plate materials produced from the scrap aluminum powder and also shows that over 60% of sound of low, medium, and high frequencies is absorbed. Further, the tensile strength of the multi-layer, porous plate material can be strengthened by rolling slightly without producing a change to the density of the pores. If the plate is rolled 2 to 3%, its strength will reach over 1.5 kg/m$^2$. Therefore, it can be used for vibrating parts such as in running engines of automotives, etc.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for the preparation of multi-layer, porous materials for use in sound absorbing devices and filter elements, which comprises:

producing aluminum powder from scrap aluminum by means of a centrifugal atomizer, sintering the aluminum powder mixed with a bonding material at a temperature of about 430° C. to 650° C. in an inactive atmosphere, and collecting said sintered aluminum mixed powder in a ceramic or graphite container in multi-layers according to increasing particle size so that a first layer contains the largest particle size and a last layer contains the smallest particle size.

2. The process of claim 1, wherein said centrifugal atomizer comprises a ceramic rotator made of silicon nitride ($Si_3N_4$) or a silicon nitride mixture ($Si_3N_4$+SiCw), and a powder collecting container, said ceramic rotator rotating at a speed of 20,000–100,000 rpm during centrifugation.

3. The process of claim 1, wherein said bonding material is selected from the group consisting of Al-6% Ni, Al-68% Mg, Al-35% Mg, Al-33% Cu, Al-13% Si, and Al-95% Zn.

4. A multi-layer, porous material produced according to the process of claim 1.

5. A multi-layer, porous material of claim 4, wherein pore configuration of said multi-layer, porous material has a shell configuration of a conch for effectively absorbing noise.

* * * * *